United States Patent [19]

Willingham

[11] 4,162,550

[45] Jul. 31, 1979

[54] HAMMOCK

[75] Inventor: Millard L. Willingham, Anniston, Ala.

[73] Assignee: Carl R. Gipson, Anniston, Ala.

[21] Appl. No.: 878,278

[22] Filed: Feb. 16, 1978

[51] Int. Cl.[2] ..... A45F 3/22

[52] U.S. Cl. ..... 5/123; 5/120

[58] Field of Search ..... 5/120, 123, 127; D6/47; 128/71

[56] References Cited

U.S. PATENT DOCUMENTS

| | | | |
|---|---|---|---|
| 2,062,069 | 11/1936 | Powers | 5/123 |
| 3,550,166 | 12/1970 | Kotler | 5/123 |

*Primary Examiner*—Casmir A. Nunberg

*Attorney, Agent, or Firm*—Woodford R. Thompson, Jr.

[57] ABSTRACT

A hammock embodying an elongated body supporting member formed of netted cords with end portions of the cords projecting beyond each end of the body supporting member. A transverse bar adjacent each end of the body supporting member has longitudinally spaced passageways therethrough for passing the end portions of the cords. Elongated flexible supports converge from opposite ends of each bar toward a support point beyond the adjacent end of the body supporting member with the support point being in alignment with the longitudinal center line of the body supporting member. The end portions of the cords are connected to the elongated flexible supports at spaced intervals along the flexible supports.

7 Claims, 6 Drawing Figures

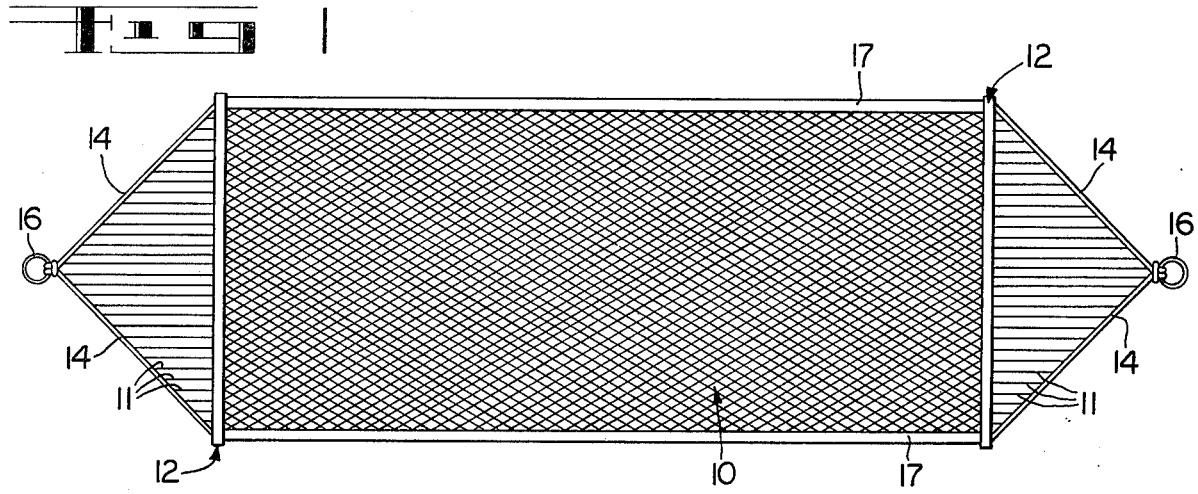
1
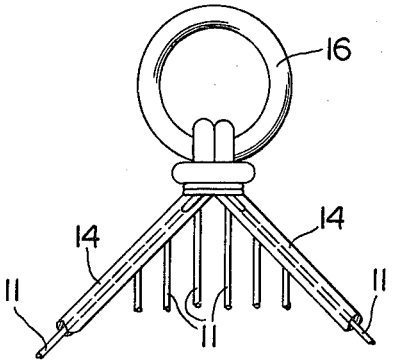
6
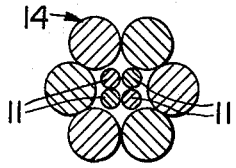
5
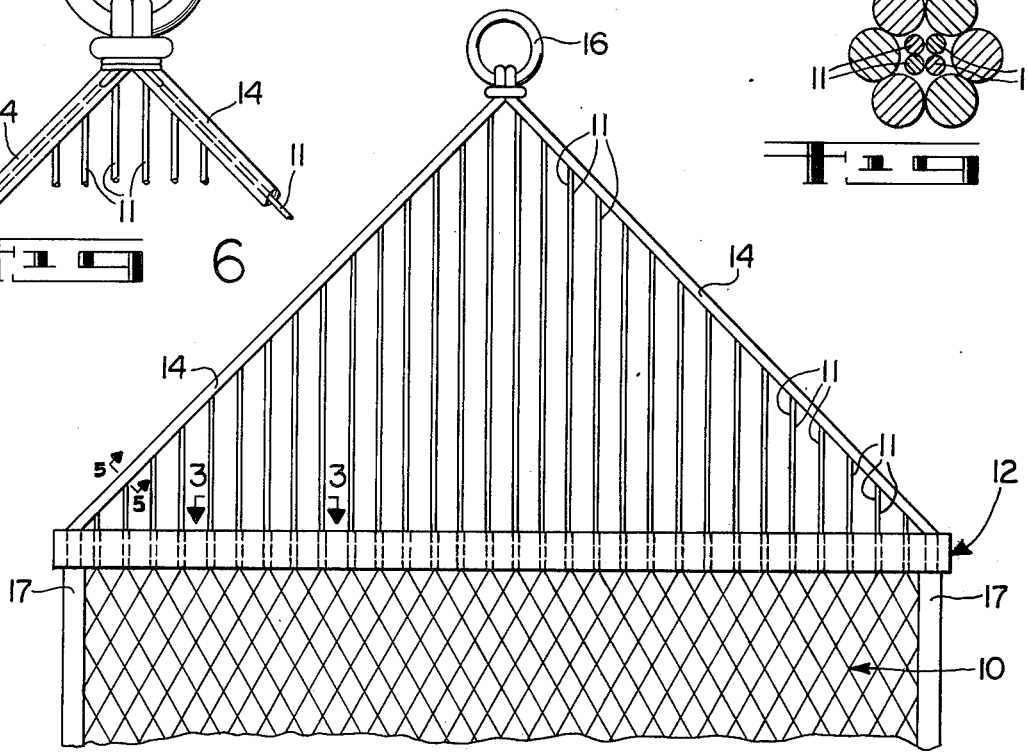
2
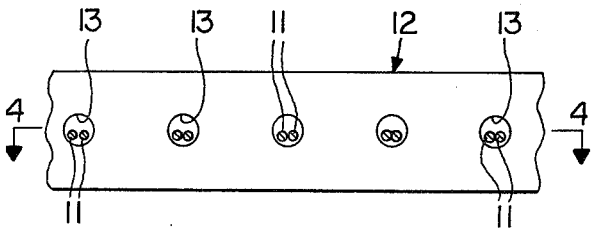
3
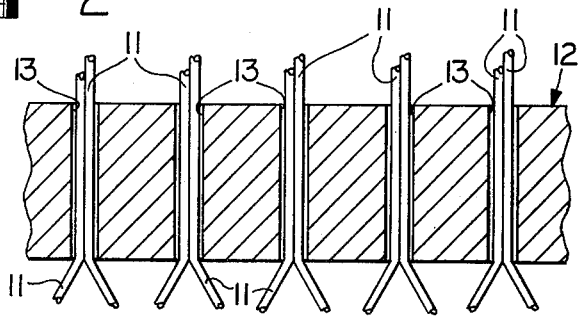
4

HAMMOCK

BACKGROUND OF THE INVENTION

This invention relates to a hammock and more particularly to such a hammock which shall include improved means for supporting the weight of an occupant whereby the hammock automatically adjusts itself to the contour and weight of the occupant and at the same time a minimum amount of stress is applied to the transverse, spreader bars for the hammock.

As is well known in the art to which my invention relates, many types of hammocks have been proposed. With all such hammocks with which I am familiar, the spreader bars extending transversely of opposite ends of the hammock are connected to a retainer element, such as a ring, by flexible members which extend from various locations on the spreader bar to the retainer ring. Accordingly, the body supporting portion of the hammock is secured rigidly to the transverse spreader bar with the spreader bar then being connected directly to the retainer ring by flexible members that extend from the spreader bar to the retainer ring. Accordingly, excessive stresses are placed on the transverse spreader bar due to the fact that the material from which the body supporting member is formed cannot adjust itself to the contour and weight of the occupant.

SUMMARY OF THE INVENTION

In accordance with my invention, I provide a hammock which comprises an elongated body supporting member formed of netted cords with end portions of the cords projecting beyond each end of the body supporting member. A transverse spreader bar is provided at each end of the body supporting member and longitudinally spaced passageways are provided through each transverse bar for passing the end portions of the cords whereby they are adapted to move freely relative to the transverse bars. Elongated flexible supports converge from opposite ends of each transverse bar toward a support point which is located beyond the adjacent end of the body support member with the support point being in substantial alignment with the longitudinal center line of the body supporting portion of the hammock. The end portions of the cords are connected to the elongated flexible supports at spaced apart intervals along the flexible supports. Accordingly, the end portions of the cords move relative to the transverse bars whereby any portion of the hammock supporting a portion of the weight of the occupant is moved downwardly and thereby causes the end portions of the cords connected to such portion to move relative to the transverse bars whereby the hammock automatically adjusts to the exact contour and weight of the occupant.

DESCRIPTION OF THE DRAWING

A hammock embodying features of my invention is illustrated in the accompanying drawing, forming a part of this application, in which:

FIG. 1 is a top plan view of my improved hammock;

FIG. 2 is an elongated view showing one end of the hammock;

FIG. 3 is a fragmental view taken generally along the line 3—3 of FIG. 2;

FIG. 4 is a sectional view taken generally along the line 4—4 of FIG. 3;

FIG. 5 is an enlarged, sectional view taken generally along the line 5—5 of FIG. 2; and, FIG. 6 is an enlarged, fragmental view showing the means for securing the elongated flexible supports to the retainer element provided at one end of the hammock.

DETAILED DESCRIPTION

Referring now to the drawing for a better understanding of my invention, my improved hammock comprises an elongated body supporting member 10 formed of netted cords with end portions 11 of the cords projecting beyond each end of the body supporting member 10, as shown in FIGS. 1 and 2. Extending transversely of each end of the body supporting member is a transverse spreader bar 12 having longitudinally spaced passageways 13 therethrough for receiving the end portions 11 of the cords, as shown in FIGS. 3 and 4. Each opening 13 is larger than the total cross sectional area of both end portions of the cords 11 passing therethrough whereby the end portions 11 are adapted to move freely relative to the transverse bar 12.

Elongated flexible supports 14 converge from opposite ends of each transverse bar 12 toward a support point located between the adjacent end of the body supporting member 10 with the support point being in substantial alignment with the longitudinal center line of the body supporting member 10. The elongated flexible supports may be in the form of rope-like members, such as ropes formed of hollow braid material. Preferably, both elongated flexible supports 14 at each end of the hammock are formed from a single length of rope-like material which is secured to a retainer element 16.

As shown in FIG. 2, each of the end portions 11 of the cord which passes through an opening 13 in the transverse bar 12 is connected to the elongated flexible supports 14 at spaced intervals along the flexible support 14. That is, instead of extending from the transverse bar 14 directly to the retainer ring 16, the end portions 11 extend generally parallel to each other with the outermost ends thereof being secured to the elongated flexible supports 14 at spaced apart intervals. Accordingly, any pull on either of the end portions 11 causes that end portion 11 to move relative to the openings 13 in the transverse bar 12 whereby pull is then made directly on the elongated flexible support 14 at the point of connection between the end portion 11 and the flexible support 14.

As shown in FIGS. 1 and 2, flexible border members 17 are secured to and extend alongside each side of the body supporting member 10 with the end of each border member 17 being secured to the end of an adjacent transverse bar 12. The border members 17 may be formed of any suitable material, such as tape or the like.

As shown in FIGS. 2, 3 and 4, the openings 13 through the transverse bars 12 extend generally parallel to each other and generally parallel to the end portions 11 of the cords. The end portions 11 of the cords nearest the ends of each transverse bar 12 extend inwardly of the adjacent elongated flexible support 14, as shown in FIG. 6, and then extend axially of the elongated flexible support 14, as shown in FIG. 5, to a point adjacent the retainer element 16. The free ends of the end portions 11 passing through the flexible supports 14 extend outwardly of the supports 14 and are then wrapped around and tied to the ends of the flexible supports 14 adjacent the retainer elements 16 to thus firmly secure the flexible rope-like supports 14 to each other and to the retainer elements 16.

From the foregoing, it will be seen that I have devised an improved hammock. By providing an elongated body supporting member formed of netted cords having end portions projecting beyond the ends of the body supporting member, together with the transverse bars having passageways therethrough for slidably receiving the end portions of the cords, my improved hammock readily adjusts itself to the contour and weight of the occupant whereby excessive tension is not applied to any part of the transverse spreader bar. Also, by connecting the end portions of the cords to the elongated, flexible supports 14 after passing the end portions 11 through the openings in the spreader bar, tension is applied at selected positions along the elongated flexible supports 14 rather than being applied directly to the retainer element 16. Furthermore, by providing parallel passageways through the transverse spreader bars 12 and then securing the outermost ends of the end portions 11 to the flexible supports 14 whereby the end portions 11 extend parallel to each other and the openings 13 through the bars 12, the end portions 11 of the cords are free to move relative to the passageways through the transverse spreader bars 12 whereby the hammock adjusts itself quickly and easily to the contour and weight of the occupant.

While I have shown my invention in but one form, it will be obvious to those skilled in the art that it is not so limited, but is susceptible of various changes and modifications without departing from the spirit thereof.

What I claimed is:

1. A hammock comprising:

(a) an elongated body supporting member formed of netted cords with end portions of said netted cords projecting beyond each end of said body supporting member, (b) a transverse bar adjacent each end of said body supporting member, (c) longitudinally spaced passageways extending through each said transverse bar receiving said end portions of said netted cords with said end portions being adapted to move freely relative to said transverse bar, (d) elongated flexible supports converging from opposite ends of each said transverse bar toward a support point located beyond the adjacent end of said body supporting member with said support point being in substantial alignment with the longitudinal center line of said body supporting member, and (e) means connecting said end portions of said netted cords to said elongated flexible supports at spaced intervals along said elongated flexible supports so that as a portion of said body supporting member supporting a portion of the weight of a body is moved downward it moves the end portions of the netted cords connected thereto relative to the transverse bars whereby the body supporting member automatically adjusts to the contour and weight of the body.

2. A hammock as defined in claim 1 in which a flexible border member is secured to and extends alongside each side of said body supporting member with the end of each border member being secured to the end of an adjacent transverse bar.

3. A hammock as defined in claim 1 in which the end portions of said netted cords extending between said transverse bar and said elongated flexible supports extend generally parallel to each other.

4. A hammock as defined in claim 1 in which said passageways through each transverse bar extend generally parallel to each other.

5. A hammock as defined in claim 1 in which said elongated flexible supports converging from opposite ends of said transverse bar are secured to a retainer element at said support point.

6. A hammock as defined in claim 5 in which said retainer element is a ring-like member.

7. A hammock as defined in claim 5 in which at least one of the outermost ones of said end portions of said netted cords extends inwardly and axially of its elongated flexible support to a point adjacent said retainer element and secures its elongated flexible support to said retainer element.

* * * * *